United States Patent [19]

Goldfarb

[11] Patent Number: 4,604,768

[45] Date of Patent: Aug. 12, 1986

[54] TRANSPARENT SELF-ADHESIVE BUMPERS FOR PROTECTING HOUSEHOLD OR OFFICE SURFACES OR ARTICLES INCONSPICUOUSLY

[76] Inventor: Adolph E. Goldfarb, 1432 S. East Wind Cir., Westlake Village, Calif. 91361

[21] Appl. No.: 756,956

[22] Filed: Jul. 19, 1985

Related U.S. Application Data

[63] Continuation-in-part of Ser. No. 541,541, Oct. 13, 1983, abandoned.

[51] Int. Cl.[4] ..... E05F 5/06

[52] U.S. Cl. ..... 16/86 A

[58] Field of Search ..... 16/82, 86 R, 86 A, 86 B

[56] References Cited

U.S. PATENT DOCUMENTS

| | | | |
|---|---|---|---|
| 2,048,274 | 7/1936 | Luby | 16/86 A X |
| 3,050,770 | 8/1962 | Morse et al. | 16/86 A |
| 3,687,792 | 8/1972 | Ruff | 16/86 A X |
| 3,969,786 | 7/1976 | Peak | 16/86 A |
| 4,218,807 | 8/1980 | Snow | 16/86 A |

*Primary Examiner*—Fred Silverberg

*Attorney, Agent, or Firm*—Romney Golant Martin Seldon & Ashen

[57] ABSTRACT

Like conventional bumpers, these transparent self-attaching bumpers for household and office use protect walls, cabinets, furniture, chinaware and other objects from damage due to impacts. By virtue of transparency and other optical properties, however, they avoid the conspicuous "spots" on the protected or guarded surfaces which conventional bumpers constitute. These bumpers are sufficiently low in optical distortion (ideally they have negligible magnification, displacement, and discontinuity), as well as in optical scattering and reflectance, to be extremely inconspicuous even when placed over distinctly patterned surfaces. These bumpers are made self-attaching either by a coating of adhesive—which is also transparent—or by forming the bumpers themselves to grip particular shaped surfaces to be protected or guarded.

8 Claims, 8 Drawing Figures

TRANSPARENT SELF-ADHESIVE BUMPERS FOR PROTECTING HOUSEHOLD OR OFFICE SURFACES OR ARTICLES INCONSPICUOUSLY

RELATED APPLICATION

This is a continuation-in-part of copending application Ser. No. 541,541, filed Oct. 13, 1983, and now abandoned.

BACKGROUND

1. Field of the Invention

This invention relates generally to protective devices for avoiding impact damage to walls, cabinetry, furniture, chinaware and other objects, and more particularly to transparent self-attaching bumpers.

2. Prior Art

A great variety of bumpers is known for cushioning the impact of swinging doors (particularly including the corners of cabinet doors) and doorknobs, hinged table sections and other panels, rolling carts, and so forth, against walls and furniture. Such bumpers protect the moving surface as well as the stationary surface, and therefore—as an example—are also used for preventing damage to toilet seats when they bump against water closets.

All of these applications, and myriad others, are well known—and have been the object of many commercial "bumper" products. The thrust of design in these products has been to provide bumpers that are sturdy, attachable to the vulnerable surface to be protected (or to the hard surface to be guarded) in a variety of ways, and reasonably attractive.

This last objective has given rise to bumpers in a great variety of shapes, sizes, expensive brushed-metal finishes, decorator colors, and so forth—but by and large has not been satisfied. Bumpers are almost intrinsically unattractive, for several reasons. They are practically by definition something "added on" to a home or office after the decor elements have been settled. They are also conspicuous by virtue of being small, spike-shaped or stubby or knobby objects secured to planar or large-contour surfaces. Attachment is often by screws, which are relatively quite large in relation to the size of each bumper itself.

Even the most esthetic of bumpers, however, are unattractive because they simply do not match the color—or the complex pattern—of the protected or guarded surfaces. They thus appear, at the very least, as non-color-matched "spots" on the wall, wallpaper, or other surface.

Turning to a different field, certain household protective functions have been served by generally transparent articles such as transparent escutcheons for electrical switches. The purpose of such articles, however, has not been to protect against damage due to impacts, but rather generally to protect against soiling of the wall surface near an electrical switch by the oily or dirty hands of users.

Moreover the problem of inconspicuous attachment of such devices is minimized—since the switch itself and its opaque switchplate, behind the transparent escutcheons, are themselves conspicuous interferences with the decor. Too, there is very little added annoyance produced by the means of attachment of the escutcheons to the switchplates—often using the same screws that attach the switchplates to the junction boxes.

In an even more remote field, U.S. Pat. No. 3,687,792 to Charles Ruff discloses a decorative trim strip for automobiles and the like. Ruff's trim strip is composed of a colored ribbon that is coextruded with a generally transparent, colorless plastic bar of trapezoidal cross-section. The ribbon is cemented to the surface to be decorated, and the angles of the plastic bar—along its edges that are elevated above the colored ribbon—are such as to trap any light entering the plastic bar.

Regardless of the angle of entry, in Ruff's invention, light is directed to the colored ribbon; in addition, only light reflected from the colored ribbon can escape the transparent plastic bar. Thus the bar, although actually colorless, appears to have the color of the underlying ribbon. The objective of Ruff's invention is to provide a trim strip that appears to have any one of a great variety of different colors even though it is only the ribbon that is actually colored. Thus the Ruff device is deliberately designed to distort the passage of light in and out of the trim strip.

Now it will be plain that if a piece of Ruff's trim strip were glued over a wall—such as a solid-color wall or a patterned-wallpaper-covered wall—in a home or office, the trim strip would be very conspicuous. It would thus fail to satisfy the needs suggested earlier.

In principle, one might propose to separate the transparent plastic bar that forms the upper portion of Ruff's trim strip from the ribbon portion. One might then propose to use only the plastic bar, in household and office applications such as outlined above.

Ruff, it must be emphasized, suggests no such possibility. His invention is in an entirely different field, and exists for an entirely different purpose, than to guard household or office surfaces inconspicuously, and he does not suggest separating the two components of his invention for any purpose. Without such a suggestion it would not be obvious to make such a modification. Even if this proposed modification of the Ruff invention were made, however, the resulting performance would be quite unsatisfactory for the purposes discussed in this document.

In the case of a uniformly colored wall, the area covered by the plastic bar would have a conspicuously different apparent illumination level than the rest of the wall. This would be a natural consequence of the deliberate design of Ruff's bar to trap all light entering at all possible entry angles and to direct such light to the underlying surface. The surface covered by the plastic bar would appear conspicuously brighter than the surrounding surface.

In the case of a patterned wall surface, dislocations would appear in the image of the pattern as seen through the plastic bar. These dislocations would be due to the abrupt differences in refraction along the distinctly angled edges of the plastic bar, well elevated in front of the wall surface.

To my knowledge there has never been any effort to combine the teachings from these various fields.

SUMMARY OF THE DISCLOSURE

Preferred forms of my invention provide transparent bumpers that are self-attaching to the vulnerable surface to be protected, or to the guarded hard surface against which some other article is to be protected. Self-attachment is provided either by transparent adhesive on the back surface of each bumper, or by configuring the bumper to grip a particular protected or guarded article.

Some of the bumpers of my invention are intended for attachment to generally planar surfaces. The front surface of each such bumper is preferably smooth, and preferably convex outward with a shallow curvature (that is to say, a large radius of curvature). If preferred the forwardmost part of the front surface may be planar, and only the more-peripheral portions shallowly curved. By virtue of this curvature it is possible to provide a fair thickness of resilient material near the center of the bumper, while avoiding the annoyance of an abrupt thick corner or edge at the periphery of the bumper—which otherwise would cause a discontinuity in refraction of light along the edge and thereby call attention to the presence of the bumper. Such a curved surface is preferred, to help hide the edge of the bumper.

If desired, the bumper material and its surface quality can be selected, using principles and techniques well known in the art of plastics engineering and molding, to minimize scattering and specular reflection and refraction while maintaining good resiliency for cushioning against impact. In addition the bumper can be made so that the optical magnification, apparent displacement, and apparent dislocation of the underlying wall pattern are very inconspicuous—or, preferably, quite negligible. These conditions can be met by avoiding sharply angled edges elevated in front of the wall surface, and by proper selection of (1) refractive index of the bumper material, (2) bumper thickness, (3) radius of curvature of the forward surface, and (4) bumper surface angles relative to the underlying wall surface.

(The terms "displacement," "dislocation," "inconspicuous" and "negligible" will be given more precise meanings, for the purposes of this document, in the detailed discussion which follows.)

Such a bumper for use on a generally planar surface has a coating of transparent adhesive at the rear, and is installed simply by being pressed into position. A slick cover sheet over the adhesive, during shipment and storage, protects the adhesive until just before use, as is common with self-adhesive labels, self-adhesive picture mounts, and other articles.

Thus the bumper is at least inconspicuous, whether applied to a surface that is a solid color or to a surface (such as wallpaper) that has an elaborate pattern with many colors. In either case the bumper permits virtually unobstructed view of the guarded or protected surface. At the same time the bumper can protect a wall against a door or doorknob, particularly the handle or corner of a cabinet door; or can protect furniture against hard edges of rolling carts; or can protect a toilet seat against repeated impact with the front of the water closet; and so forth.

Such bumpers for use on generally planar surfaces may also be used on generally cylindrical surfaces or on irregularly curved surfaces, if the radius of curvature of the surface is not too small. For instance, some appliances such as refrigerators have broadly curved door surfaces, and my bumpers can protect these against impact with the corners of other appliances, of furniture, or of walls. Similarly, some homes and offices have round pillars, which—if they are not too small in diameter—can be protected by my bumpers.

Other bumpers in accordance with my invention are specially made to grip particular surfaces or articles to be protected or guarded. In many such cases, the adhesive may be omitted.

For example, many domestic and industrial chores involve moving fragile glassware, chinaware, laboratory instruments, and the like, in close proximity to hard protrusive fixtures such as water faucets. It is a commonplace source of exasperation and wasted resources to break such fragile articles (while washing them, for instance) by striking them inadvertently against such hard fixtures.

Transparent self-attaching bumpers of my invention simply fit over such fixtures—as, for example, slide in a snug fit over the end of a water-faucet nozzle—and grip such fixtures to hold themselves in place. Once thus simply and immediately installed, they cushion the impact of the fragile articles. By virtue of transparency they interfere very little with the appearance of the sink or other use area.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

Figure 1:
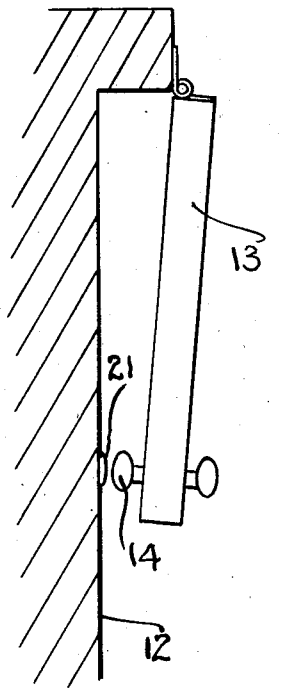
FIG. 1 is a schematic plan view of a bumper in accordance with my invention installed on a wall (shown in cross-section) to protect the wall against impact by a doorknob.
Figure 2:
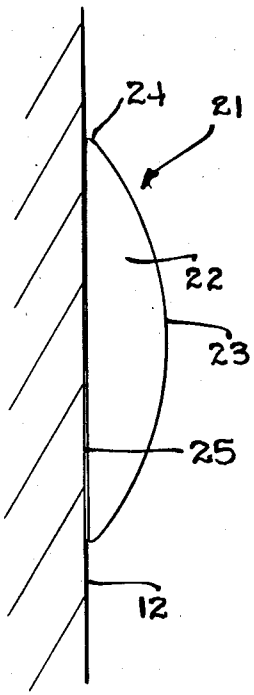
FIG. 2 is an enlarged view of the FIG. 1 embodiment, also in plan (and also showing the wall in section).
Figure 3:
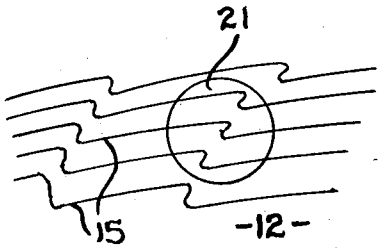
FIG. 3 is an elevation of the embodiment of FIGS. 1 and 2, showing a bumper that is generally circular in frontal shape and showing a patterned wall or wallpaper.

As shown in FIGS. 1 through 3, a bumper 21 in accordance with my invention is simply pressed against a wall such as 12, in position to intercept a doorknob 14 of swinging door 13—or any other similar hard article that repetitively strikes the wall 12 in generally the same position. The corners and handles of cabinet doors are particularly troublesome in this regard, and my invention is particularly useful in avoiding impact damage due to them. The back surface of the bumper 21 is provided with a layer of transparent adhesive 25, by which the bumper 21 is attached to the wall 12.

The bumper material 22 is itself transparent and resilient. Suitable materials satisfying these criteria, and the others to be specified below, can be provided by a person skilled in the art of plastics engineering and molding.

The forward surface 23 of the bumper 21 is smooth, but not highly shiny; and is convex outward, but with a shallow curvature (that is to say, a large radius of curvature) over almost all of its extent. The index of refraction of the material 22 should be as low as practical.

Because of the surface smoothness and lack of shininess there is very little scattering and very little specular reflection of lights within the room or other area. Consequently the surface color and the pattern 15 of the wall 12 show through the surface 23 as well as through the bulk 22 of the bumper material. Because of the shallow curvature and low index of refraction, there is relatively little refraction, and therefore there is relatively little visual interference with the pattern details 25 of the wall 12. This preservation of wall patterns is particularly beneficial in the case of finely patterned wallpaper.

At the extreme periphery of the bumper 21 there may be provided a relatively more strongly curved "break" 24—a relatively abrupt truncation of the shallow curvature of the surface 23. This change of curvature serves to provide greater strength and uniformity of appearance than would be obtained with a relatively sharp peripheral "edge". As previously mentioned, the convexity of the overall frontal surface 23 of the bumper 21 helps to hide the periphery of the bumper: it brings the periphery, whether a curved break or a sharp edge, very close to the underlying wall surface. Placing the periphery so close to the wall minimizes the possibility of refractive displacements of the underlying pattern, as well as the possibility of noticeable shadows cast by the bulk of the bumper onto the wall.

In short, if the break is sufficiently close to the edge—and therefore very close to the underlying wall surface when the bumper is installed—refractive and umbral effects will be unnoticeable in normal use. To help keep the refractive effects small, even when the break is positioned at the extreme periphery of the bumper 21, the "break" 24 is preferably given some curvature rather than being made a sharply defined edge.

Figure 4:
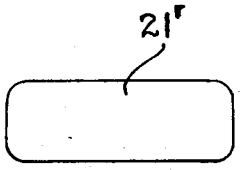
FIG. 4 is an elevation of an embodiment that is similar to that of FIG. 3 but has a different frontal shape.

The invention is not limited to generally circular bumpers 21 such as that shown in FIG. 3, but may also be used to provide bumpers of virtually any convenient shape, such as the generally rectangular bumper 21' shown in FIG. 4.

The wall-protective bumpers of my invention preferably produce minimal distortion of patterned or uniform wall surfaces. Ideally the distortion should be negligible or unnoticeable under ordinary viewing conditions. To obtain this result the bumper can be made so that the optical magnification, apparent lateral displacement, and apparent dislocation of the underlying wall pattern are very inconspicuous—or, again ideally, quite negligible.

By "displacement" I mean the distance between the actual position of a point on the wall surface behind the bumper and the image, produced by the bumper, of that same point. By "lateral displacement" I refer to that component of the displacement which is perpendicular to the line of sight. By "dislocation" I mean a break or jump in the appearance of the wall pattern, caused by the bumper.

Magnification of an underlying pattern may be considered "inconspicuous" if, for example, the magnification is less than fifty percent—in other words, if the magnification is less than 1.50 times. Magnification may be considered "negligible" if it is less than, say, fifteen percent—in other words, less than 1.15 times. These values may be appreciated simply by mentally visualizing the effect of looking casually at a small portion of a wallpaper pattern that is magnified by 1.50 or 1.15 times, respectively.

Similarly, lateral displacement may be considered "inconspicuous" if the viewer is perhaps two or more meters (six or more feet) from a wall and the lateral displacement is one centimeter or less. Lateral displacement may be considered "negligible" for the same viewing distances if it is, say, three millimeters or less.

As previously indicated, these various conditions can be met by avoiding sharply angled edges elevated in front of the wall surface, and by proper selection of (1) refractive index of the bumper material, (2) bumper thickness, (3) radius of curvature of the forward surface, and (4) bumper surface angles relative to the underlying wall surface.

More specifically, apparent dislocations of the pattern are made negligible by avoiding sharply angled edges at positions substantially elevated in front of the underlying surface—such as the elevated edges shown in the Ruff patent. Not only abrupt dislocations, however, but also overall apparent displacement of a continuous sort, can be conspicuous.

As to apparent lateral displacement, it is to be understood that the amount of such displacement depends upon the angle at which the person's gaze (the line of sight) lies relative to the "normal". (In geometry a "normal" is a line drawn perpendicular to a surface.) In addition, the conspicuousness of the lateral displacement depends upon the distance of a viewing person from the bumper.

When the viewer observes the bumper at a very large angle from the normal, the amount of refractive displacement (as well as the amounts of scattering and reflection) can be quite large—particularly if the dimensions of the bumper are unfavorable.

Moreover, at very large viewing angles the bumper can actually obscure portions of the wall pattern. This effect too can be minimized by optimizing the bumper dimensions.

It is not strictly necessary to reduce the lateral displacement and other effects to an insignificant level for very large viewing angles. In practice, people do not ordinarily direct their gaze in a purposeful manner to particular areas of a wall, at very large viewing angles relative to the wall. Moreover, even if they do so, the overall visual angle subtended by one of my bumpers is made smaller by the cosine effect, while the same effect renders the pattern details of the wall less distinct.

Hence as a practical matter it is reasonable to configure one of my bumpers to perform well only at viewing angles less than, say, sixty or seventy degrees. This point will be explored further below.

The following equation shows the approximate relationship between the lateral component w of the optical displacement produced at any point on a curved frontal surface of one of my bumpers:

$$w = h\left(\sin X - \cos X \tan\left[Y + \sin^{-1}\frac{\sin(X \pm Y)}{n}\right]\right),$$

in which h is the height of the bumper-surface point in front of the patterned wall surface, X the viewing angle relative to the normal, Y the bumper-surface angle at the point of interest relative to the surface of the underlying wall, and n the index of refraction of the bumper material.

This equation may be simplified for points at which the bumper frontal surface is parallel to the underlying wall surface—such points as will typically be found at, for example, the apex of a spheroidal or like bumper—by setting Y equal to zero, so that:

$$w_p = h\left(\sin X - \cos X \tan\left[\sin^{-1}\frac{\sin X}{n}\right]\right).$$

Now I will define F as the factor appearing in parentheses in the equation above, and the equation may be rewritten $w_p = h \cdot F$. This equation represents an important case, since the parallel-surface point produces the largest value of displacement anywhere on the surface. This is true because the height h is greatest at the parallel-surface apex. The effect of larger surface angles Y (at points on the frontal surface at the far side of the bumper from the viewer) tends to be compensated by the effect of the accompanying smaller heights h above the wall surface.

Although "inconspicuous" bumpers can be made allowing apparent displacements $w_p$ as large as one centimeter, I prefer to make bumpers in which the lateral displacement $w_p$ will be "negligible"—three millimeters or less. It develops that this can be easily accomplished even for high refractive index. To find the maximum permissible apex height $h_{max}$ for any particular value of apparent displacement $w_p$ at the apex, the simplified equation above is solved for h in terms of $w_p$, $$h = w_p/F,$$

and the permissible displacement value is inserted for $w_p$. Of course the refractive index must also be supplied.

The factor F varies with viewing angle X and refractive index n in a way that is somewhat surprising and useful for purposes of practicing my invention:

| X | F | | |
|---|---|---|---|
| (degrees) | n = 1.3 | n = 1.45 | n = 1.65 |
| 0 | 0.00 | 0.00 | 0.00 |
| 10 | 0.04 | 0.05 | 0.07 |
| 20 | 0.09 | 0.11 | 0.14 |
| 30 | 0.14 | 0.18 | 0.22 |
| 40 | 0.21 | 0.26 | 0.32 |
| 50 | 0.30 | 0.37 | 0.43 |
| 60 | 0.42 | 0.49 | 0.56 |
| 70 | 0.58 | 0.65 | 0.70 |
| 80 | 0.78 | 0.82 | 0.86 |
| 90 | 1.00 | 1.00 | 1.00 |

This tabulation shows that F cannot exceed 1.00, regardless of the refractive index. This means that the lateral displacement $w_p = h \cdot F$ cannot exceed the bumper thickness h, regardless of index.

From these facts it should now be apparent that one very simple way to configure my transparent bumpers to prevent the lateral displacement from exceeding any desired value is to make the thickness of the bumpers equal to that lateral-displacement value. In other words, we can use the value $F_{max} = 1.00$, and find $h_{max} = w_p/F_{max} = w_p$. If the bumpers are ten millimeters thick, the lateral displacement will not exceed ten millimeters—and will be "inconspicuous" as defined above. If the bumpers are three millimeters thick, the lateral displacement will not exceed three millimeters—and accordingly will be "negligible."

For reasonable cushioning effect it is preferable to have at least a 2½-millimeter thickness of plastic (varying with material, as elsewhere noted). This condition is easily satisfied within the constraint presented above for "negligible" lateral displacement.

If better cushioning is desired (or if for any other reason it is considered very important to use a thicker bumper), and in particular if this consideration is more important than the appearance of the wall pattern at very large viewing angles, then as previously suggested the performance of the bumper at large viewing angles can be sacrificed slightly to obtain greater thickness. In this connection it is possible to take advantage of the variation of F with refractive index at intermediate viewing angles, to select a material whose index of refraction yields sufficiently low lateral displacement $w_p = h_{max} \cdot F$ at some intermediate angle such as sixty or seventy degrees.

As indicated earlier, the importance of extreme viewing angles may be discounted by virtue of the cosine effect on the visibility of wall-pattern details, in combination with the normal casual viewing habits of people generally. At a horizontal viewing angle of seventy-five degrees the overall visual angle subtended by the width of a bumper is only about one-quarter the actual width of that bumper (though the apparent height of the bumper remains the true height), making the entire bumper reasonably inconspicuous in the usual sense of that word.

By reference to the tabulation presented above it can be seen that $h_{max}$ may be kept between, for example, $w_p/0.70$ (at seventy degrees, n=1.65) and $w_p/0.42$ (for sixty degrees, n=1.3). These values correspond to 1.42 $w_p$ and 2.38 $w_p$ respectively. Summarizing, and including some additional intermediate values for sixty and seventy degrees:

| displacement effect | $w_p$ (mm) | maximum "important" view angle X (degrees) | maximum bumper height (mm) n = 1.3 | n = 1.45 | n = 1.65 |
|---|---|---|---|---|---|
| "inconspicuous" | 10 | 60 | 24 | 20 | 18 |
| | | 70 | 17 | 15 | 14 |
| | | 90 | 10 | 10 | 10 |
| "negligible" | 3 | 60 | 7 | 6 | 5 |
| | | 70 | 5 | 5 | 4 |
| | | 90 | 3 | 3 | 3 |

As seen from this tabulation, even for refractive index of 1.65 the bumper may be eighteen millimeters (1.8 centimeter) thick if the greatest viewing angle considered "important" is sixty degrees. At index 1.30, however, the bumper may be twenty-four millimeters (2.4 centimeters) thick for the same viewing angle; thus there is an advantage to use of material with lower index, when trading off viewing angle for thickness.

Now turning to the matter of magnification, it will be helpful first to explore the dimensional requirements if the bumper has a spheroidal front surface. For simplicity's sake it also will be assumed that the overall diameter of the bumper is just large enough to effectively catch a doorknob—say, one inch (2½ centimeters). In addition it will be assumed that the peripheral portion of the surface has a "break" about 1.5 millimeter tall—in other words, that the spheroidal surface terminates 1.5 millimeter away from the underlying wall surface, when the bumper is installed.

Under these assumptions the radius of curvature of the spheroidal surface must be roughly (in centimeters):

$$R = \frac{d^2}{8\,(h - 0.15)} + \frac{h - 0.15}{2}.$$

Concentrating on the values in the preceding tabulation, and recalling that $w_p$ is three millimeters for "negligible" displacement and ten millimeters for "inconspicuous" displacement,

| displacement effect | $w_p$ (mm) | maximum "important" view angle X (degrees) | radius of curvature R (cm) n = 1.3 | n = 1.45 | n = 1.65 |
|---|---|---|---|---|---|
| "inconspicuous" | 10 | 60 | 1.5 | 1.4 | 1.3 |
| | | 70 | 1.3 | 1.3 | 1.3 |
| | | 90 | 1.3 | 1.3 | 1.3 |
| "negligible" | 3 | 60 | 1.7 | 1.9 | 2.2 |
| | | 70 | 2.3 | 2.7 | 3.0 |
| | | 90 | 5.3 | 5.3 | 5.3 |

This summary tabulation shows that allowing the apparent displacement to be merely "inconspicuous" rather than fully "negligible" is not necessarily more desirable in terms of radius of curvature. The ten-millimeter apex displacement $w_p$ seems to lead to a maximum permissible height $h_{max}$ of ten to twenty-four millimeters; but if these height values are actually used, the corresponding radius of curvature—for a 2½-centimeter overall diameter—becomes extremely sharp. The radius is 1.3 to 1.5 centimeters, depending upon index of refraction and viewing angle.

A similar result appears for the "negligible" displacement figures, if one attempts to take actual advantage of the intermediate-angles tradeoff: in these cases the radius goes to 1.7 to 3.0 centimeters.

The resulting magnification values are unacceptable. The corresponding magnification M of the wall pattern as viewed along the normal to the wall (that is to say, looking straight toward the wall; X=0) may be calculated from—

$$M = \frac{1}{1 + \frac{h}{R}\left(\frac{1}{n} - 1\right)}.$$

For the same conditions in the two preceding tabulations, the magnification is:

| displacement effect | $w_p$ (mm) | maximum "important" view angle X (degrees) | magnification M n = 1.3 | n = 1.45 | n = 1.65 |
|---|---|---|---|---|---|
| "inconspicuous" | 10 | 60 | 1.60 | 1.87 | 2.20 |
| | | 70 | 1.45 | 1.61 | 1.81 |
| | | 90 | 1.21 | 1.30 | 1.41 |
| "negligible" | 3 | 60 | 1.11 | 1.11 | 1.11 |
| | | 70 | 1.05 | 1.06 | 1.06 |
| | | 90 | 1.01 | 1.02 | 1.02 |

Looking first at the upper half of this tabulation, the conditions (namely, bumper height of ten millimeters) previously identified with so-called "inconspicuous" lateral image displacement produce very large values of magnification. These values are as high as 2.20, which represents an increase of one hundred twenty percent in apparent size. Even the smallest value of magnification in the upper half of the table is 1.21, or a twenty-one percent increase. This value, and the other values given for maximum important viewing angle of ninety degrees do fall in the range of magnification values previously identified as "inconspicuous," but they are not in the "negligible" range.

Most of the other magnification values in the upper half of the table are likely to make the pattern seen through the bumper very conspicuously different from the pattern adjacent to the bumper. Furthermore, the curvature is so strong that conspicuous reflective effects are likely to appear, and in fact the bumper will protrude rather prominently from the wall.

To avoid these characteristics it becomes necessary either to make the overall diameter considerably larger, so as to spread the height over a larger lateral dimension and thereby reduce the magnification, or simply to reduce the height below the maximum value that was found to be permissible when considering only displacement.

Using the former option, the height and lateral dimension combine to produce very large, bulky articles which are correspondingly expensive to manufacture, stock, package and distribute. These articles are also unnecessarily large in terms of the desired wall-surface protection. (Moreover, as will be recalled, image displacement is only "inconspicuous" rather than "negligible".) The latter option is far preferable, since it provides lower costs and better apparent image displacement. Cushioning is adequate with suitable choice of materials.

The best solution is to reduce the height to the values shown earlier for "negligible" displacement. Referring to the last tabulation above, the magnification is only 1.01 to 1.11—i.e., a size increase that is between one and eleven percent.

It will be understood, however, that my invention encompasses all such parameter combinations in the so-called "inconspicuous" category, as well as the so-called "negligible" cases.

Now in view of the spheroidal-surface cases discussed above it should be understood that irregularly shaped bumper frontal surfaces may be much more difficult to analyze, or may be straightforwardly comprehended from the analysis already presented, depending on the degree of irregularity.

Figure 8:
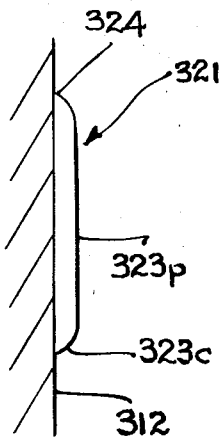
FIG. 8 is a plan view of an embodiment related to the FIG. 2 embodiment.

For example, as shown in FIG. 8 a bumper 321 with a curved outer portion 323*c* leading upwardly to an essentially planar middle portion 323*p* will produce maximum displacement in its planar middle region. The displacement so produced in the planar region can be calculated from the apex-displacement equation already stated. In that same central region the magnification will be zero, by virtue of the planar surface. If the curved outer part 323*c* is circular in cross-section, the magnification in that region can be found from the magnification equation above—considering the outer part 323*c* as if it were part of an entirely spheroidal bumper of the same radius of curvature. (This magnification of course occurs only in the direction of the curvature.) The overall diameter of the bumper, however, will be larger by virtue of the planar portion 323*p*. It will be understood that a bumper of the sort described in this paragraph need not be circular in overall shape, but rather may be shaped as at 21' in FIG. 4.

Bumper curvature in the curved portion 323*c* of FIG. 8—and indeed at any part of the frontal surface of any of the bumpers in FIGS. 1 through 4—may be ellipsoidal, parabolic, or simply "gradually tapered" without any particular geometric definition. In any event the local curvature and height at a particular surface point may be used to find the apparent displacement and magnification at that point for purposes of optical-performance evaluation.

Using good-quality transparent plastic my invention should produce no conspicuous discontinuity of apparent illumination—as between the underlying wall surface that is covered by a bumper and the adjacent wall surface that is not so covered. An exception may arise in a very thin annular area at the extreme periphery, immediately adjacent to the underlying wall surface. Otherwise lighting discontinuity should be inconspicuous—in photographic terms well under a half-stop (a factor of about 1.4). With ordinary care in design the lighting discontinuity should be negligible—less than a quarter-stop (a factor of 1.2).

For comparison, the Ruff plastic trim strip has, as it appears from his drawings, between approximately thirty-seven and fifty-six percent more light-collecting surface than underlying surface to be illuminated. Assuming isotropic illumination, the apparent illumination of the wall area behind one of his clear plastic strips would be 1.37 to 1.56 times brighter than the uncovered wall area.

Figure 5:
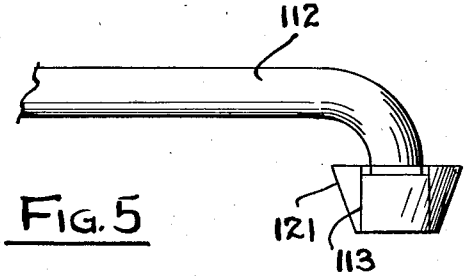
FIG. 5 is an elevation of another embodiment of my invention, installed on a conventional water faucet.
Figure 6:
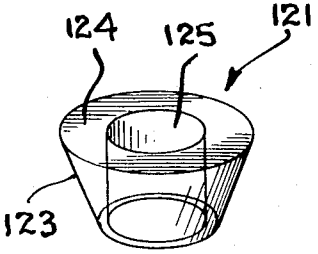
FIG. 6 is an isometric view of the FIG. 5 embodiment detached from the faucet.

Another embodiment of my invention appears in FIGS. 5 and 6. In FIG. 5 the bumper 121 fits over the tip or filter section 113 of an ordinary faucet or water spout 112. The tip section 113 is here assumed to be generally cylindrical; hence the internal surface 125 of the bumper 121 is also generally cylindrical. The outer surface 123 may if desired be generally conical as shown, to minimize mechanical interference with activities nearest the tip of the faucet. If preferred to yield even better impact guarding, however, the outer surface 123 may instead be generally cylindrical.

The top and bottom surfaces may be generally planar, normal to the axis of the faucet tip, as suggested at 124 in FIG. 6. As will be apparent, many other shapes are also practical.

Figure 7:
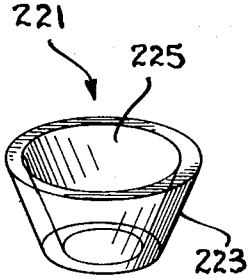
FIG. 7 is an isometric view of an embodiment similar to that of FIGS. 5 and 6 but adapted to fit a water faucet of slightly different tip shape.

A variant of the embodiment of FIGS. 5 and 6 appears in FIG. 7. Here the bumper is made to fit over a faucet tip that is tapered or generally conical; consequently the internal surface 225 of the bumper too is correspondingly tapered or generally conical.

It is to be understood that all of the foregoing detailed descriptions are by way of example only, and not to be taken as limiting the scope of my invention—which is expressed only in the appended claims.

For the purposes of the appended claims the term "consumer" and the term "home" or "household" shall be understood to encompass, respectively, "office worker" and "office".

I claim:

1. A bumper for use by consumers at home, in protecting patterned household surfaces and household articles from damage due to impact with one another, and comprising:

a resilient, generally transparent body that is substantially free of any opaque attachment, and that is shaped to fit directly against such a household surface; and means for use by such consumer at home in attaching the body to the household surface of the consumer's choice, without any opaque intermediary, and without interfering with the transparency of the body, so that the bumper permits generally unobstructed view of the household surface;

the portion of the body that does not fit against the surface being curved and substantially free from discontinuities, except at its extreme periphery immediately adjacent to the surface; and the body being sufficiently thin, and the material of the body having a sufficiently low index of refraction, and the portion of the body that does not fit against the surface having sufficiently shallow curvature, that the body produces only inconspicuous magnification, and at usual viewing angles only inconspicuous apparent displacement, of the pattern detail of the household surface of the consumer's choice said magnification, and at usual viewing angles said apparent displacement, are substantially negligible, wherein: the magnification does not exceed 1.15, and at viewing angles of sixty degrees to the normal or less the apparent displacement does not exceed three millimeters;

whereby the bumper protects the household surface and household articles from damage due to impact with one another while being inconspicuous, even if the household surface has an elaborate pattern with many colors.

2. The bumper of claim 1 wherein:

the attaching means comprise a layer of generally transparent adhesive that is prevented from setting until so attached by the consumer at home, and is otherwise maintained in condition for use by the consumer at home in attaching the body to the household surface of the consumer's own choice.

3. A bumper for use by consumers at home, in protecting patterned household surfaces and household articles from damage due to impact with one another, and comprising:

a resilient, generally transparent body that is substantially free of any opaque attachment, and that is shaped to fit directly against such a household surface; and means for use by such consumer at home in attaching the body to the household surface of the consumer's choice, without any opaque intermediary, and without interfering with the transparency of the body, so that the bumper permits generally unobstructed view of the household surface;

the portion of the body that does not fit against the surface being curved and substantially free from discontinuities, except at its extreme periphery immediately adjacent to the surface; and the body being sufficiently thin, and the material of the body having a sufficiently low index of refraction, and the portion of the body that does not fit against the surface having sufficiently shallow curvature, that the body produces only inconspicuous magnification, and at usual viewing angles only inconspicuous apparent displacement, of the pattern detail of household surface of the consumer's choice; wherein the magnification does not exceed 1.50, and the apparent lateral displacement does not exceed one centimeter at any viewing angle;

whereby the bumper protects the household surface and household articles from damage due to impact with one another while being inconspicuous, even if the household surface has an elaborate pattern with many colors.

4. The bumper of claim 3, wherein:

the magnification does not exceed 1.15, and the apparent lateral displacement does not exceed three millimeters at any viewing angle.

5. A bumper for use by consumers at home, in protecting household surfaces and household articles from damage due to impact with one another, and comprising:

a resilient, generally transparent body that is substantially free of any opaque attachment, and that is shaped to fit directly against such a household surface; and means for use by such consumer at home in attaching the body to the household surface of the consumer's choice, without any opaque intermediary, and without interfering with the transparency of the body, so that the bumper permits generally unobstructed view of the household surface;

the portion of the body that does not fit against the surface being curved and sufficiently free from discontinuities, except at its extreme periphery immediately adjacent to the surface, as to prevent imaging dislocations and prevent conspicuous discontinuity in apparent illumination of the surface of the consumer's choice, except at the extreme periphery immediately adjacent to the surface; and the body being sufficiently thin, and the material of the body having a sufficiently low index of refraction, and the portion of the body that does not fit against the surface having sufficiently shallow curvature, that the body produces only inconspicuous magnification, and at usual viewing angles only inconspicuous apparent displacement, of the surface of the consumer's choice; wherein: the magnification does not exceed 1.50, and at viewing angles of sixty degrees or less the apparent displacement does not exceed one centimeter;

whereby the bumper protects the household surface and household articles from damage due to impact with one another while being inconspicuous, regardless of whether the household surface is of extremely uniform appearance or has an elaborate pattern with many colors.

6. The bumper of claim 5, wherein:

the attaching means comprise a layer of generally transparent adhesive that is prevented from setting until so attached by the consumer at home, and is otherwise maintained in condition for use by the consumer at home in attaching the body to the household surface of the consumer's own choice.

7. The bumper of claim 5, wherein:

the magnification does not exceed 1.15, and at viewing angles of sixty degrees to the normal or less the apparent displacement does not exceed three millimeters.

8. The bumper of claim 5, wherein:

discontinuity of illumination, except at the extreme periphery of the body immediately adjacent to the surface, is less than a factor of 1.4 as between the portion of the surface that is covered by the body and the portion of the surface that is not covered by the body.

* * * * *